US005484269A

United States Patent [19]

Vick

[11] Patent Number: 5,484,269

[45] Date of Patent: Jan. 16, 1996

[54] FLUID INTENSIFIER

[75] Inventor: Ralph L. Vick, Granada Hills, Calif.

[73] Assignee: Moog Inc., East Aurora, N.Y.

[21] Appl. No.: 426,883

[22] Filed: Apr. 24, 1995

[51] Int. Cl.[6] ..... F04B 17/00; F04B 35/02

[52] U.S. Cl. ..... 417/225; 417/401; 417/521; 417/534

[58] Field of Search ..... 417/225, 226, 417/401, 521, 254, 534

[56] References Cited

U.S. PATENT DOCUMENTS

| | | | |
|---|---|---|---|
| 2,296,647 | 9/1942 | McCormick | 417/225 |
| 2,532,679 | 12/1950 | Slater | 417/225 |
| 2,539,292 | 1/1951 | Anderson | 417/225 |
| 2,864,313 | 12/1958 | Dawson | 417/225 |
| 3,086,470 | 4/1963 | Skipor et al. | 417/225 |
| 3,720,484 | 3/1973 | Kirshsieper | 417/521 |
| 4,051,877 | 10/1977 | Fletcher et al. | 417/225 |
| 4,229,143 | 10/1980 | Pucher et al. | 417/402 |
| 4,601,642 | 7/1986 | Andrews | 417/225 |
| 4,631,000 | 12/1986 | Burandt | 417/225 |
| 4,767,282 | 8/1988 | Igarashi et al. | 417/225 |

FOREIGN PATENT DOCUMENTS

| | | | |
|---|---|---|---|
| 3228494 | 2/1984 | Germany | 417/225 |

*Primary Examiner*—Richard A. Bertsch
*Assistant Examiner*—William Wicker
*Attorney, Agent, or Firm*—Phillips, Lytle, Hitchcock, Blaine & Huber

[57] ABSTRACT

A fluid intensifier (10) includes an unequal-area pump piston (11) and a drive piston (14). The large-area pump piston chamber (21) communicates with the small-area pump piston chamber (29) via a communicating conduit (30) having a check valve (25) therein. The pump piston is coupled to a drive piston (14) having a lost-motion connection (18) with a two-lobed pilot valve spool (41). The pilot valve (16) controls a pilot pressure in the spool end chamber (60) of a spring-biased control valve (19). The fluid intensifier is automatically reversing as the pump piston approaches either end of its stroke, and is arranged to provide a substantially-constant intensified fluid pressure ($P_i$) at an outlet.

11 Claims, 4 Drawing Sheets

FLUID INTENSIFIER

FIELD OF THE INVENTION

The present invention relates generally to devices for increasing the pressure of a supplied fluid at the expense of flow, and, more particularly, to an improved fluid intensifier that is adapted to operate in conjunction with a single-acting drive piston.

BACKGROUND ART

Fluid intensifiers that is, devices that will provide an increased or intensified fluid pressure at the expense of a flow, are known.

One example of a prior art fluid intensifier is shown and described in U.S. Pat. No. 2,296,647, the aggregate disclosure of which is hereby incorporated by a reference. That device broadly includes a driving piston, a driven or pump piston, a reversing valve, and a lost-motion connection. Certain end-of-stroke sensors are operatively arranged to automatically reverse the driving piston in order to provide intensified output pressure on either stroke. However, the device shown in the '647 patent is comparatively large and cumbersome, and therefore expensive. Moreover, this device appears to use four-way control valves in association with an equal-area driving piston. By this later term, it is meant that the piston has equal-areas on its opposite faces.

Accordingly, it would be generally desirable to provide an improved fluid intensifier of simpler design, which allows the use of unequal-area pistons and three-way control valves.

DISCLOSURE OF THE INVENTION

With parenthetical reference to the corresponding parts, portions and surfaces of the disclosed embodiment, merely for purposes and illustration and not by way of limitation, the present invention broadly provides an improved fluid intensifier (10). The improved intensifier includes a pump piston (11) mounted for sealed sliding movement within a pump cylinder (12); a rod (13) having one end mounted on the pump piston and having a portion (31) sealingly penetrating an end wall (32) of the pump cylinder; the pump piston having a large-area surface (20) facing into a first end chamber (21) and having a small-area surface (28) facing into a second end chamber (29); a first source of pressurized fluid (P,); an inlet conduit (22) operatively arranged to permit only unidirectional flow of fluid from the first source to the first end chamber (21); a communicating conduit (30) operatively arranged to permit only unidirectional flow from the first end chamber (21) to the second end chamber (29); an outlet conduit (24) operatively arranged to permit only unidirectional flow from the second end chamber to an outlet; a drive piston (14) mounted for sealed sliding movement within a drive cylinder (15), the drive piston being connected to the rod (13) for movement therewith, the drive piston having a surface (34) facing into a drive end chamber (35); a second source, of pressurized fluid ($P_s$); and a control valve (19) for alternately communicating the drive end chamber (35) with the second source or a fluid return such that when the drive end chamber communicates with the second source, the pump piston will be driven to decrease the volume of the first end chamber and to provide a first intensified pressure ($P_{i1}$) at the outlet, and when the drive end chamber communicates with the return, the pump piston will be driven to decrease the volume of the second end chamber and to provide a second intensified pressure ($P_{i2}$) at the outlet.

In the preferred embodiment, the first and second fluid sources are the same, and the first and second intensified pressures are substantially the same (i.e., $P_{i1}=P_{i2}$). The control valve may include a three-way control valve (19) that is responsive to a pilot pressure ($P_p$). The control valve may further include a two-position three-way pilot valve (16) for selectively providing pilot pressure ($P_p$) to the control valve as a function of the position of the pilot valve, and a lost-motion connection (18) between the pilot valve and drive piston such that, as the drive piston approaches the end of its stroke in either direction, the pilot valve will be shifted to an opposite position, whereby the pump piston will be automatically reciprocated within the pump cylinder to continuously provide intensified pressure ($P_{i1}$ or $P_{i2}$) at the outlet. The large-area pump piston surface (20) may be substantially twice the area of the small-area pump piston surface (28). The area of the large-area pump piston surface (20) may be substantially equal to the area of the drive piston surface (34). The inlet, communicating and outlet conduits may severally have check valves (23, 25, 26, respectively) incorporated therein to constrain fluid to flow unidirectional therethrough.

Accordingly, the general object of this invention is to provide an improved fluid intensifier.

Another object is to provide an improved fluid intensifier of improved and simplified design, that allows the use of unequal-area pistons and three-way control valves.

These and other objects and advantages will become apparent from the foregoing and ongoing written specification, the drawings, and the appended claims.

DESCRIPTION OF THE PREFERRED EMBODIMENTS

Figure 1:
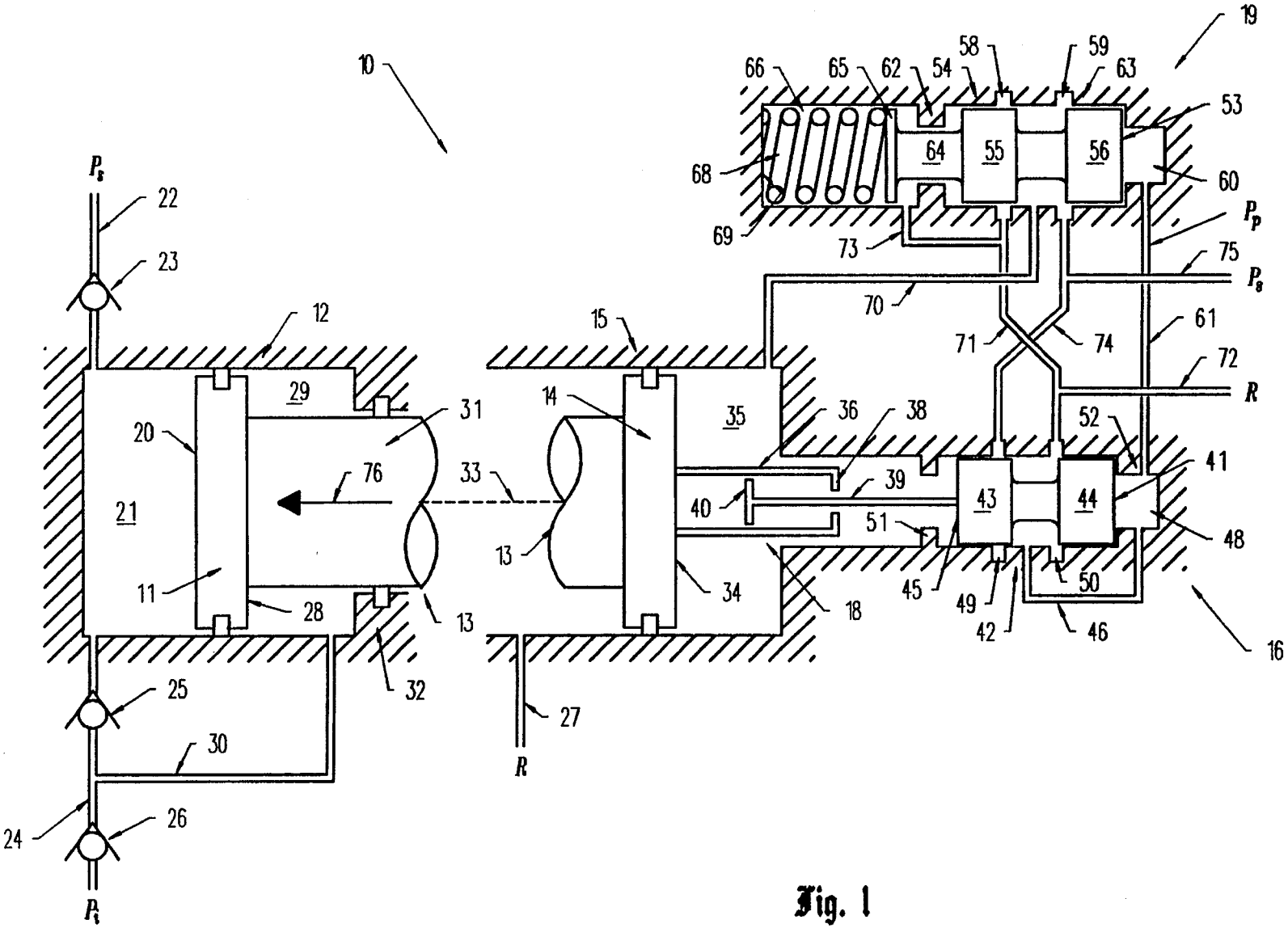
FIG. 1 is a schematic view of the improved intensifier, this view showing the pump-and-drive piston assembly as being at an intermediate position of its stroke and as moving leftwardly in response to the rightwardly-shifted positions of the pilot and control valves.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.) simply refer to the orientation of the illustrated structure as the particular drawing figure normally faces the reader. Similarly, the terms "inwardly" and "outwardly" generally refer to the orientation of a surface relative to its axis of elongation, or axis or rotation, as appropriate.

Referring now to the drawings, and, more particularly, to FIG. 1 thereof, the present invention broadly provides an improved fluid intensifier, generally indicated at 10. While the improved intensifier will be described herein with respect to hydraulic operation, it should be clearly understood that the invention may be used with gases as well. Thus, as used in the appended claims, the term "fluid" is intended generically to encompass either a liquid, a gas, or a combination thereof.

The improved intensifier 10 is shown as broadly including a pump piston 11 mounted for sealed sliding movement within a pump cylinder 12; a rod 13; a drive piston 14 mounted for sealed sliding movement within a drive cylinder 15; a pilot valve, generally indicated at 16, operatively arranged to provide a pilot pressure $P_p$; a lost-motion connection, generally indicated at 18, operatively arranged between the drive piston and the pilot valve; and a control valve, generally indicated at 19. The various elements just described are connected by various communicating passages, as will be described infra.

The pump piston 11 is shown as having a large-area circular vertical left surface 20 facing into a first end chamber 21. Pressurized fluid from a suitable first source, indicated at $P_s$, is supplied to the inlet of an inlet conduit 22 containing a check valve 23. First pump end chamber 21 communicates with an outlet via an outlet conduit 24 containing check valves 25 and 26, respectively. Thus, intensified pressure, $P_i$, is available at the outlet. Pump piston 11 is also shown as having a smaller-area annular vertical right surface 28 facing into a second end chamber 29. A communicating conduit 30 connects chamber 29 with outlet conduit 24 between check valves 25 and 26. Thus, fluid is constrained to flow from pump first end chamber 21 to pump second end chamber 29 via check valve 25, and from the second end chamber to the outlet via check valve 26.

Rod 13 is shown as having its left end fixed to pump piston 11, and as having an intermediate portion 31 sealing penetrating an end wall 32 of the pump cylinder. The right end of rod 13 is connected to the drive piston. However, since the portion of rod 13 that is outside of the pump piston is not exposed to fluid pressure, as indicated by conduit 27 continuously communicating with the fluid return R, an intermediate portion of rod 13 is simply represented by a dashed line 33.

The drive piston 14 is shown as having a small-area annular vertical left end face, and a larger-area annular vertical right surface 34 facing into a drive end chamber 35. The lost-motion connection 18 is shown as having a horizontally-elongated cylindrical sleeve 36 extending rightwardly from the drive piston and having an in-turned right end wall 38. A small diameter rod 39 penetrates end wall 38 and has an enlarged head portion 40 captured within sleeve 36. This is not a piston-and-cylinder because head 40 does not sealingly engage the walls of sleeve 36. Rather, the fluid in drive chamber 35 exists to the right of sleeve 36, and is also present within sleeve 36 on both sides of head portion 40.

Pilot valve 16 is shown as having a two-lobed valve spool 41 mounted for sealed sliding movement within a pilot valve cylinder 42. The left and right lobes of spool 41 are indicated at 43 and 44, respectively. The right end of rod 39 is connected to pilot spool 41. Hence, the head portion 40 of the lost-motion connection and pilot spool 41 move together. The pressure in drive chamber 35 is applied to the left end face 45 of the pilot valve spool. Passageway 46 communicates the space between pilot spool lobes 43, 44 with a chamber 48 extending into the right end of the pilot piston cylinder. Thus, the pilot pressure ($P_p$) between lobes 43, 44 is continually applied to the pilot valve spool right end face. Lobes 43, 44 are arranged to selectively cover or uncover annular ports 49, 50, respectively, that extend into the pilot valve body. Thus, the pilot valve spool 41 is mounted for sliding movement within cylinder 42 between a left stop 51 and a right stop 52.

The control valve 19 is shown as having a spring-biased two-lobed valve spool 53 mounted for sliding movement within a control valve 54. The left and right lobes of the control valve are indicated at 55 and 56, respectively. Lobes 55, 56 are arranged to selectively cover or uncover annular ports 58, 59, respectively, that extend into the control valve body. The right end of the control valve cylinder is provided with an end chamber 60 that is in constant communication with pilot valve end chamber 48 via conduit 61. Thus, the pilot pressure in pilot valve end chamber 48 also exists in control valve end chamber 60. The control valve is mounted for sealed sliding movement between a left stop 62 and a right stop 63. A rod 64 extends leftwardly from lobe 55, and non-sealingly penetrates left stop 62 and terminates in a push-plate 65 within a spring chamber 66. A coil spring 68 is operatively arranged in chamber 66 to act between spring chamber left wall 69 and push-plate 65. Spring 68 is compressed, and continuously urges the control valve spool to move rightwardly relative to the control valve cylinder, to the position shown in FIG. 1. Drive chamber 35 continuously communicates with the space between control valve lobes 55, 56 via a conduit 70. Conduit 71 communicates control valve port 58 with pilot valve port 50, and also communicates with a fluid return R via a branch conduit 72. Conduit 71 also communicates with the spring chamber 66 via a branch conduit 73.

Conduit 74 communicates control valve port 59 with pilot valve port 49, and communicates with a second pressure source, $P_s$, via a branch conduit 75. The fluid source to which conduit 75 is connected may be the same as, or different from, the first source to which inlet conduit 22 is connected. For the sake of simplicity, both fluid sources are indicated as being arranged to supply fluid at an inlet pressure $P_s$. However, in some alternative embodiment, these two fluid sources and/or their respective pressures, could be different. The fluid return may be a sump at zero pressure, or at some other pressure below the pressure of the source.

Operation

FIG. 1 depicts the positions of the pilot and control valves that cause the pump piston to move leftwardly. For the sake of discussion, it is assumed that there is no pressure drop across the various check valves 23, 25 and 26. In other words, for the purpose of discussion, it is assumed that the check valves simply insure that flow through the associated passageway is unidirectional. Thus, for all intents and purposes, supply pressure $P_s$ communicates with pump left chamber 21 unless the pressure in chamber 21 is greater than $P_s$.

It should also be noted that in FIG. 1, spring 68 has expanded to urge control valve 53 to move rightwardly to abut stop 63. Similarly, pilot valve spool 41 is shown as abutting right stop 52, where it is positively held by supply pressure $P_s$ acting on the left end face of lobe 43, while the right end face of lobe 44 is exposed to pilot pressure, $P_p$, which is at return pressure. In this arrangement, supply pressure $P_s$ is admitted through conduit 75, and passes through uncovered control valve port 59 and conduit 70 to enter drive piston end chamber 35. The pressure in the pump piston end chamber 21 is increased, and this intensified pressure communicates via conduit 30 with the annular vertical right second pump chamber 29. Thus, the intensified pressure acts the net area of the rod (i.e., $A_{20}-A_{28}=A_{13}$) to exert a rightward force on the pump piston. However, supply pressure is also present in drive end chamber 35 and acts against the larger-area face 34 of the drive piston. Hence, the pump-and-drive piston assembly will move leftwardly, in the direction of arrow 76. As this occurs, the volume of first pump end chamber 21 will decrease as fluid at intensified pressure $P_i$ passes through outlet conduit 24 to the outlet.

Such leftward motion of the pump-and-drive piston assembly will continue and be accommodated by the lost-motion connection 18. However, as the pump piston approaches the end of its stroke the head portion 40 of the lost-motion connection will abut sleeve end wall 39 and pull the pilot valve from the rightwardly-shifted position shown in FIG. 1 to an alternate leftwardly-shifted position shown in FIG. 2. As lobe 44 covers port 50 and lobe 43 uncovers port 49, supply pressure will be admitted via conduits 75, 74 and 46 to pilot valve right end chamber 48 and control valve end chamber 60. This will cause the pilot piston to be pressure-balanced, and will allow the lost-motion connection to continue to pull the pilot piston leftwardly toward the position shown in FIG. 2.

Figure 2:
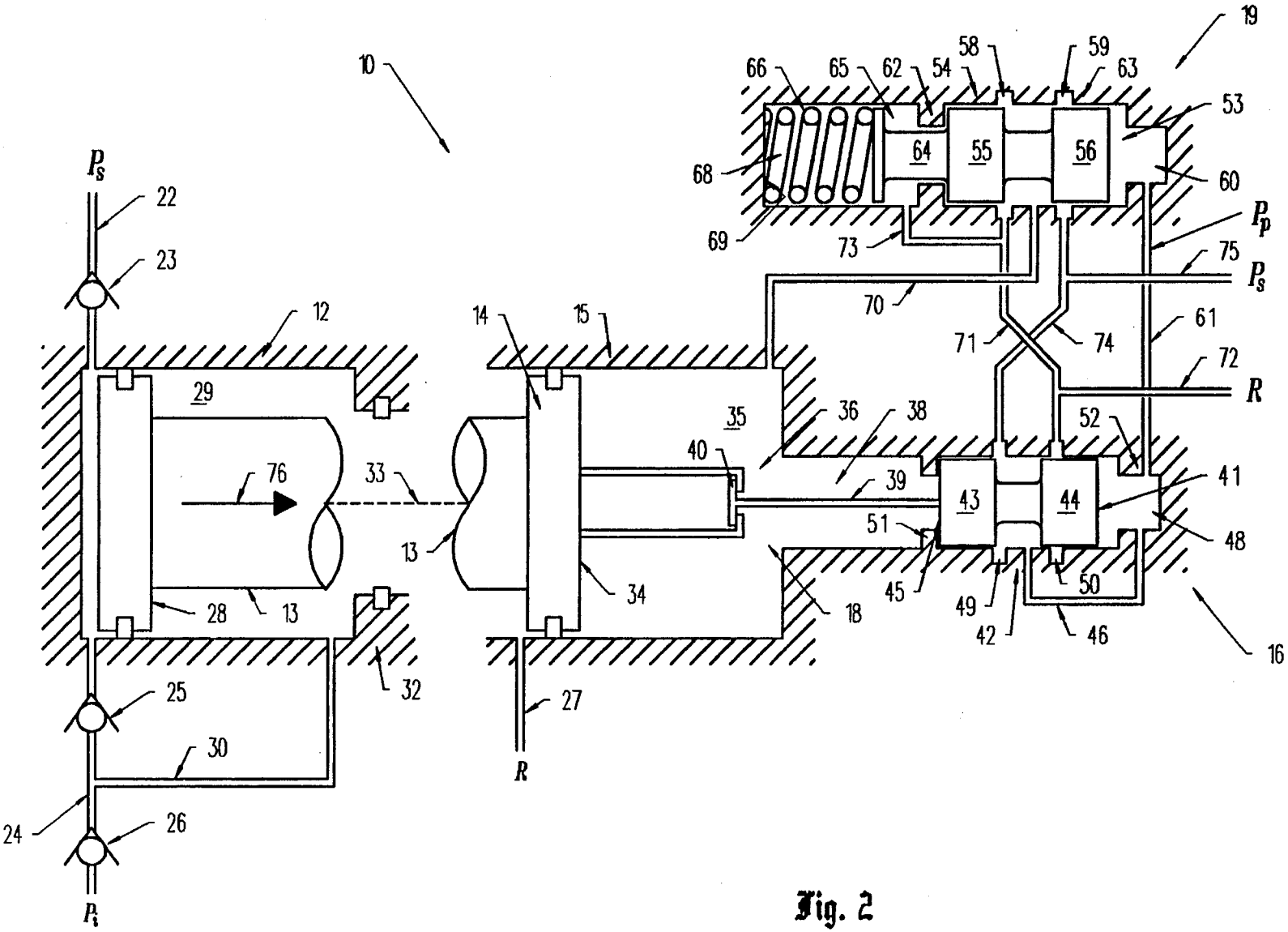
FIG. 2 is a similar schematic view thereof, but showing the pump-and-drive piston as assembly as beginning to move rightwardly just after the end of its leftward stroke in response to the leftwardly-shifted positions of the pilot and control valves.
Figure 3:
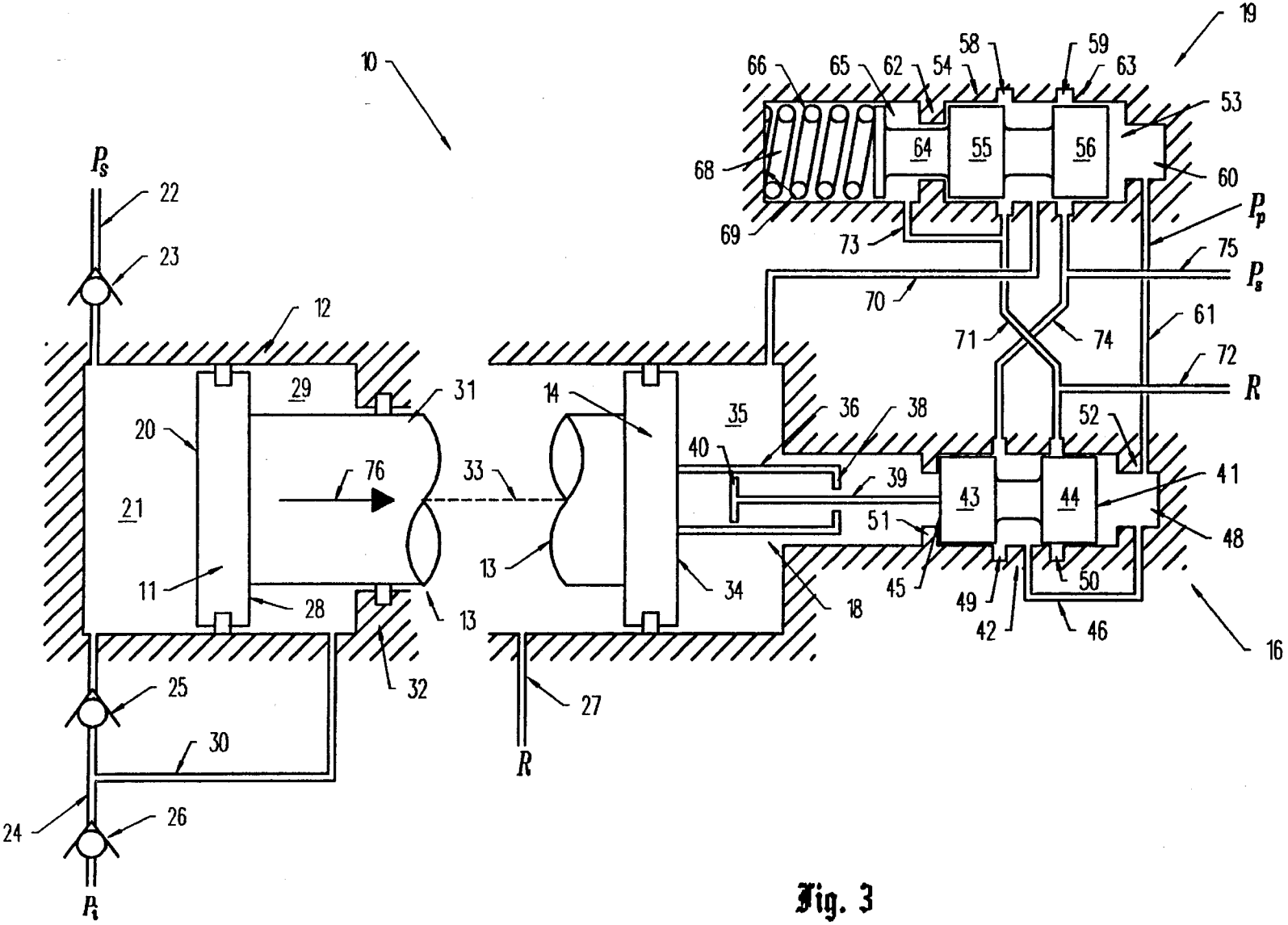
FIG. 3 is a similar schematic view thereof, this view showing the pump-and-drive piston assembly as being at an intermediate position of its stroke and as moving rightwardly in response to the leftwardly-shifted positions of the pilot and control valve.

When the pilot valve goes through its null position (i.e., when pilot lobe 44 covers port 50 and pilot lobe 43 uncovers port 49), supply pressure will also be admitted to control valve end chamber 60. Since the spring chamber is continually vented to return via conduits 73, 71 and 72, the sudden appearance of supply pressure in end chamber 60 will quickly snap the control spool leftwardly until left lobe 55 abuts stop 62, as shown in FIG. 2. In this now-shifted position, drive chamber 35 will communicate with the fluid return via conduits 70, 71 and 72. Hence, the supply pressure in pump piston first chamber 21 will displace the pump-and-drive piston assembly rightwardly, thereby forcing fluid from pump piston right chamber 29 via communicating conduit 30 and check valve 26 to the outlet. Such rightward motion of the pump-and-drive piston assembly will continue and be accommodated by lost-motion connection 18. At the same time, the pilot valve will be positively held against stop 45 by supply pressure $P_s$ acting on its right end face, while the left end face is exposed to return pressure.

Figure 4:
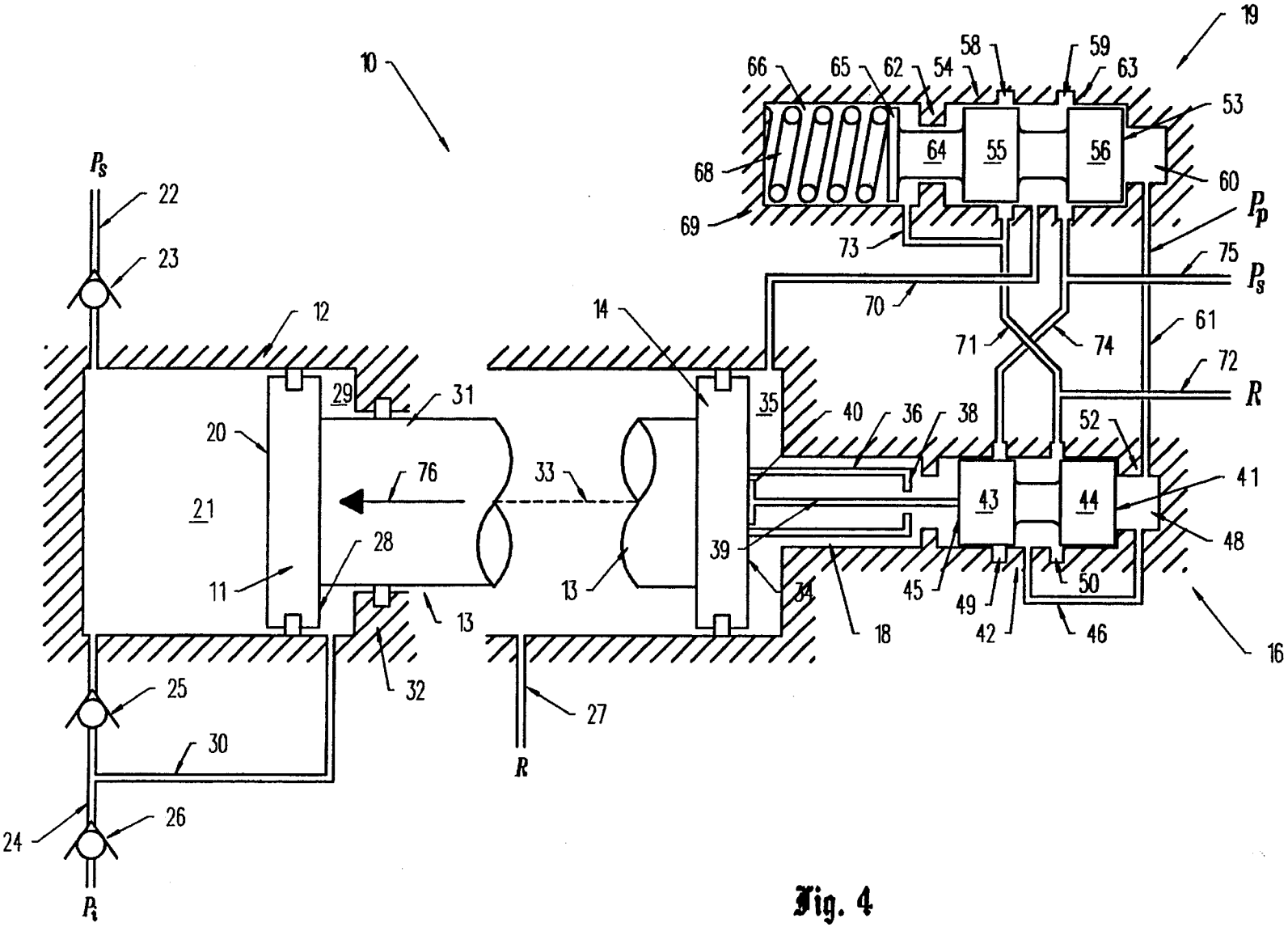
FIG. 4 is a similar schematic view thereof, but showing the pump-and-drive piston assembly as beginning to move leftwardly just after the end of its rightward stroke in response to the rightwardly-shifted positions of the pilot and control valves.

Ultimately, when the pump piston approaches the rightward end of its stroke, the head portion 40 of the lost-motion connection will abut the drive piston, such that further rightward motion of the drive piston will shift the pilot valve spool rightwardly within the pilot valve cylinder. As the pilot valve is shifted rightwardly, and selectively covers port 49 and uncovers port 50, the pressure in pilot valve right end chamber 48 will communicate with return. This will also cause the pressure in control valve right end chamber 60 to communicate with return thereby allowing spring 68 to expand and snapping the control valve rightwardly, to the position shown in FIG. 4. Such rightward movement of the control valve will cover port 58 and uncover 59, again allowing fluid to flow from the source via conduits 75 and 70 into drive chamber 35. Thus, in this manner the improved intensifier is automatically reversed as the pump piston approaches either end of its stroke.

Modifications

The present invention contemplates that many changes and modifications may be made. The present invention desirably permits the use of unequal-area pump and drive pistons. In the preferred embodiment, there is a preferred area relationship between the pump-and-drive pistons. The ratio of the areas of the surfaces of pump piston faces 20, 28 is selected to equal the ratio of the area of drive piston surface 34 to the cross-sectional area of rod 13. Or, $A_{surface20}/A_{surface28}=A_{surfaces34}/A_{surface31}$. While this is preferred to provide the same intensified pressure $P_i$ for either direction of motion, it should be clearly understood that these relative ratios may be changed or modified. The pump-and-drive piston sub assembly may be a dumbbell-shaped member, as shown, or may have other shape or configuration, as desired. The lost-motion connection may be of the form shown, or may be of some other form or structure. Similarly, while the invention is shown as having spool-type pilot and control valves, either or both of these may be changed or modified by other types of functionally-operably valves. As previously noted, the fluid sources to which conduits 75 and 22 are connected may be the same or different. Similarly, the sources may be at the same or different pressures.

Therefore, while a presently preferred form of the improved intensifier as been shown and described, and several changes and modifications thereof discussed, persons skilled in this art will readily appreciate the various additional changes and modifications may be made without departing from the spirit of the invention, as defined in differentiated by the following claims.

What is claimed is:

1. A fluid intensifier, comprising:

a pump piston mounted for sealed sliding movement within a pump cylinder;

a rod having one end mounted on said pump piston and having a portion sealingly penetrating an end wall of said pump cylinder;

said pump piston having a large-area surface facing into a first end chamber and having a small-area surface facing into a second end chamber;

a first source of pressurized fluid;

inlet conduit means operatively arranged to permit unidirectional flow from said first source to said first end chamber;

communicating conduit means operatively arranged to permit unidirectional flow from said first end chamber to said second end chamber;

outlet conduit means operatively arranged to permit unidirectional flow from said second end chamber to an outlet;

a drive piston mounted for sealed sliding movement within a drive cylinder, said drive piston being connected to said rod for movement therewith, said drive piston having a surface facing into a drive end chamber;

a second source of pressurized fluid; and control valve means for alternately communicating said drive end chamber with said second source or a fluid return such that when said drive end chamber communicates with said second source, said pump piston will be driven to decrease the volume of said first end chamber and to provide a first intensified pressure at said outlet and when said drive end chamber communicates with said return, said pump piston will be driven to decrease the volume of said second end chamber and to provide a second intensified pressure at said outlet.

2. A fluid intensifier as set forth in claim 1 wherein said first and second sources are the same.

3. A fluid intensifier as set forth in claim 1 wherein said first and second intensified pressures are substantially the same.

4. A fluid intensifier as set forth in claim 1 wherein the area of said large-area pump piston surface is substantially twice the area of said small-area pump piston surface.

5. A fluid intensifier as set forth in claim 1 wherein the area of said large-area pump piston surface is substantially equal to the area of said drive piston surface.

6. A fluid intensifier as set forth in claim 1 wherein said inlet conduit means includes an inlet check valve.

7. A fluid intensifier as set forth in claim 1 wherein said communicating conduit means includes a communicating check valve.

8. A fluid intensifier as set forth in claim 1 wherein said outlet conduit means includes an outlet check valve.

9. A fluid intensifier as set forth in claim 1 wherein said control valve means includes a three-way control valve responsive to a pilot pressure.

10. A fluid intensifier as set forth in claim 9, and further comprising:

a two-position three-way pilot valve for selectively providing pilot pressure to said control valve as a function of the position of said pilot valve; and lost-motion means connecting said pilot valve to said drive piston such that as said drive piston approaches its maximum travel in either direction, said pilot valve will be shifted to an opposite positions.

whereby said pump piston will be automatically reciprocated to continuously provide intensified pressure at said outlet.

11. A fluid intensifier as set forth in claim 10 wherein said pilot valve has first and second end areas, and further comprising a first conduit for applying the pressure in said drive end chamber to said pilot valve first end area, and a second conduit for applying said pilot pressure to the said pilot valve second end area, whereby said pilot valve is positively held in either of two positions.

* * * * *